US007234520B2

(12) United States Patent
Khomynets et al.

(10) Patent No.: US 7,234,520 B2
(45) Date of Patent: Jun. 26, 2007

(54) WELL JET DEVICE FOR TESTING AND STUDYING FORMATIONS AND THE OPERATING METHOD THEREOF

(76) Inventors: Zinoviy Dmitrievich Khomynets, d.33. ul. Vilshanetskaya, Tismenitsa, obl, Ivano-Frankovskaya, 77400 (UA); Vladimir Petrovich Stenin, ul. Kulakova, 10-88, Moscow, 123592 (RU)

( * ) Notice: Subject to any disclaimer, the term of this patent is extended or adjusted under 35 U.S.C. 154(b) by 334 days.

(21) Appl. No.: 10/494,109

(22) PCT Filed: Sep. 20, 2002

(86) PCT No.: PCT/RU02/00426

§ 371 (c)(1),
(2), (4) Date: Oct. 25, 2004

(87) PCT Pub. No.: WO03/038281

PCT Pub. Date: May 8, 2003

(65) Prior Publication Data

US 2005/0053473 A1 Mar. 10, 2005

(30) Foreign Application Priority Data

Oct. 31, 2001 (RU) ..... 2001129306
Dec. 13, 2001 (RU) ..... 2001133328

(51) Int. Cl.
*E21B 47/01* (2006.01)
*E21B 23/14* (2006.01)

(52) U.S. Cl. ..... 166/250.01; 166/370; 166/385; 166/387; 166/66; 166/106

(58) Field of Classification Search ..... 166/250.01, 166/250.17, 369, 370, 381, 385, 386, 387, 166/66, 68, 68.5, 73, 105, 106, 241.5, 66.4, 166/117.7
See application file for complete search history.

(56) References Cited

U.S. PATENT DOCUMENTS 1,626,057 A * 4/1927 Vaughn et al. ..... 417/109
4,988,389 A * 1/1991 Adamache et al. ..... 166/302
6,116,340 A * 9/2000 Wilson et al. ..... 166/250.17

* cited by examiner

*Primary Examiner*—Kenneth Thompson
(74) *Attorney, Agent, or Firm*—James H. Walters

(57) ABSTRACT

The invention relates to jet devices and the operating methods thereof and can be used in order to produce and intensify the oil inflow from a well. The inventive device comprises a jet pump arranged on a tubing string in the well with a casing string. An active nozzle and a mixing chamber are coaxially arranged in the body of said pump and a bypass channel provided with a mounting seat for a sealing unit with an axial channel or for functional inserts with autonomous instruments is embodied. The output of the pump is connected to an annular space of the tubing string, the input of a channel for supplying a working medium to the active nozzle being connected to the internal space of the tubing string above the sealing unit. A channel for removing the medium pumped out from the well is connected to the internal cavity of the tubing string below the sealing unit. Said device is also provided with a radiation source and a receiver-transducer of physical fields and a packer. The pump and a packer are arranged in the well below the casing string. The tubing string is provided with a rotating mechanism which is disposed between said pump and packer. The section of the tubing string disposed above the rotating mechanism is arranged in such a way that it is rotatable with respect to the rotating mechanism of the tubing string disposed thereunder by means of a drive arranged on the surface. Said rotating mechanism is disposed above the packer at a distance equal to or higher than the external diameter thereof. The aim of said invention is to increase the efficiency of tests and the reliability of information received during said tests.

2 Claims, 2 Drawing Sheets

WELL JET DEVICE FOR TESTING AND STUDYING FORMATIONS AND THE OPERATING METHOD THEREOF

FIELD OF THE INVENTION

The invention relates to jet devices, primarily to well jet devices and methods of operating them, which are used for the production and intensification of oil inflow from wells.

PRIOR ART

Known in the art is a well jet device comprising a packer, a check valve and a jet pump with the active nozzle, a mixing chamber, a diffuser, the central channel for supplying a passive medium and a locking element, all of them being installed on the tubing string, and a geophysical instrument being installed on the logging cable passed through the said locking element (RU 2121610 C1).

The said device enables to pump various extracted media, e.g., oil, out of the well while simultaneously processing the extracted medium and the formation near-well area; but it does not enable to preclude repeated contamination of the formation with the working medium after stopping the operation of the pump unit, which narrows the field of application of the device.

Known in the art is a method of operating a well jet device, which includes lowering into the well of a tubing string with a jet pump, a packer and a radiation source and a receiver-transducer of physical fields where the latter is arranged below the jet pump (RU 2129671 C1).

The said device enables to pump various extracted media, e.g., oil, while simultaneously studying the well, the said radiation source and the receiver-transducer of physical fields being arranged with the possibility of moving reciprocally along the well axis relative to the jet pump and the formation; but in a number of case this is not sufficient for obtaining full information on the well condition, which reduces the efficacy of the work on intensifying oil production from the well.

The closest to the invention in respect of a device, as to the technical essence and the achieved result, is a well jet device comprising a jet pump, which is installed on the tubing string in a well with the casing string; in the body of the said jet pump an active nozzle and a mixing chamber being coaxially arranged and a through passage being made with a mounting seat for the installation of a sealing unit having an axial passage or replaceable functional inserts with autonomous instruments installed under them; the output side of the jet pump being connected to hole clearance around the tubing string; the input side of a passage for supplying the working medium to the active nozzle of the jet pump being connected to the inner cavity of the tubing string above the sealing unit; and a channel for supplying the medium pumped out of the well by the jet pump being connected to the inner cavity of the tubing string below the sealing unit; the said device being provided with a radiation source and a receiver-transducer of physical fields and with a packer that are installed, respectively, on the cable and on the tubing string below the jet pump (RU 2129671 C1).

The said well jet unit enables to study wells. But, if the jet pump is arranged in the well below the casing string, sticking of equipment becomes possible due to the fact that the well walls are not fixed, and, when conducting studies in the well, in the result of pressure differences the risk that the well walls may collapse grows significantly, which may result in increasing the well study time due to the necessity of removing the jet pump to the surface for liquidating said sticking, as well as the reliability of information obtained during studies is reduced.

The closest to the invention in respect of the method, as to the technical essence and the achieved result, is a method of operating a well jet device, which includes the installation on the tubing string a packer and a jet pump in the body of which a through passage with a mounting seat is made, the lowering of that unit into a well, the release of the packer and the arrangement of borehole instruments in the well below the jet pump (RU 2129672 C1).

The said method of operating a well jet device enables to perform various process operations in the well below the level at which the jet pump is installed, including those performed by creating a pressure difference above and below the sealing unit. But the said well jet device does not enable to use its opportunities in full, which is associated with the absence of operations aimed at precluding actions related to the prevention of sticking of the tubing string with the jet pump when arranging them in a well which walls have not been fixed with a casing string.

DESCRIPTION OF THE INVENTION

The objective to be achieved with the application of this invention is to raise the working reliability and productivity while studying and testing formations in wells with walls which have not been fixed with a casing string, as well as improving the reliability of well logging information obtained at early stages of well building.

The stated objective in respect of the device is achieved owing to that the well jet device for testing and studying formations comprises a jet pump installed on the tubing string in a well with the casing string, in the body of the jet pump an active nozzle and a mixing chamber are coaxially arranged and a through passage is made with a mounting seat for installing either a sealing unit with an axial passage or replaceable functional inserts with autonomous instruments arranged below them, the output side of the jet pump is connected to the tubing string annular space, the input side of the passage for supplying the working medium to the active nozzle of the jet pump is connected to the inner cavity of the tubing string above the sealing unit, and the passage for supplying the medium pumped by the jet pump out of the well is connected to the inner cavity of the tubing string below the sealing unit, the said well jet device being provided with a radiation source and a receiver-transducer of physical fields and with a packer, these being arranged, respectively, on the cable and on the tubing string below the jet pump, the jet pump and the packer being arranged in the well below the casing string, the tubing string being provided with a rotating mechanism being arranged between the jet pump and the packer, and the section of the tubing string disposed above the rotating mechanism being arranged with the possibility of rotating it relative to the section of the tubing string disposed under the rotating mechanism by means of a drive arranged on the surface, and the rotating mechanism being arranged above the packer at a distance equal to or greater than the external diameter of the packer.

The stated objective in respect of the method is achieved owing to that the method of operating the well jet device when testing and studying wells consists in that installed, bottom-up, are an input cone with a shank, a packer, a rotating mechanism and a jet pump, in the latter's body a stepwise through passage with a mounting seat between the steps being made, the whole assembly is lowered on the tubing string into the well, the said input cone being arranged not lower than the bed of the producing formation; then the packer is released, and the section of the tubing string, which is disposed above the rotating mechanism, is rotated; then, lowered into the well, through the jet pump, are a radiation source and a receiver-transducer of physical fields together with the sealing unit that is movable arranged on the logging cable or a wire above the lug for connecting a radiation source and a receiver-transducer of physical fields; the sealing unit is arranged onto the mounting seat in the through passage of the jet pump body while ensuring the possibility for reciprocal motion of the logging cable or the wire; during the process of lowering background measurements of temperature and other physical fields are conducted from the head to the bottom of the well; then the radiation source and the receiver-transducer of physical fields are arranged above the bed of the producing formation; the near-well area of the formation is cleared of the drilling fluid filtrate by supplying a liquid medium to the active nozzle of the jet pump, successively creating several values of pressure drawdown on the formation and registering, at each value, well bottom pressures, the composition and the physical parameters of the fluid coming out of the producing formation as well as the well output; in the course of the above operations temperature anomalies emerge against the working intervals of the formation in the result of draining the latter; then, while operating the jet pump at a set value of pressure drawdown on the formation, the radiation source and the receiver-transducer of physical fields are moved along the well axis in the area of the producing formation, and the inflow profile, the parameters of the formation fluid, the well bottom pressure as well as changes of the physical fields in the near-well and the remote areas of the formation are all registered; the possibility of performing the above operations several times is provided for both at the above-mentioned set value of pressure drawdown on the formation and at another value of pressure drawdown on the formation; then the supply of the liquid medium to the jet pump is stopped, the radiation source and the receiver-transducer of physical fields together with the logging cable and the sealing unit are removed out of the well, and the section of the tubing string disposed above the rotating mechanism is rotated; then, lowered along the tubing string and installed on the mounting seat of the through passage is an insert for recording curves of formation pressure restoration in the under-packer area of the well, the said insert being lowered together with a sampler and an autonomous instrument provided with a pressure sensor, a temperature sensor, a flow rate sensor, a formation fluid composition sensor, etc.; then a necessary pressure drawdown on the formation is created by supplying the liquid medium to the nozzle of the jet pump, and after the set time of draining the producing formation the supply of the liquid medium to the jet pump nozzle is stopped abruptly, and after the set time of recording a curve of formation pressure restoration in the under-packer area of the well the functional insert for recording curves of formation pressure restoration is removed together with the sampler and the autonomous instrument; the section of the tubing string disposed above the rotating mechanism is rotated once again; and the jet pump together with its assembly is removed out of the well to the surface.

In a number of cases studies and tests of formations in wells are to be carried out in sections where the casing string is not installed. As a result, it is necessary to arrange a jet pump and a packer below the casing string, in the area with non-fixed well walls. Pressure differences, which are formed in the well at, e.g., creating a pressure drawdown or in the result of pumping the medium out of the under-packer area of the well, collapses of well walls are possible, which results in sticking the equipment being in the well. It primarily relates to the tubing string and the jet pump arranged under the packer. As the conducted studies show, regular rotation of the section of the piping string with the jet pump arranged above the packer enables to avoid their sticking in the course of studying the well after releasing the packer and after removing the radiation source and the receiver-transducer of physical fields out of the well. It is associated with the fact that in the process of rotating the tubing string it is possible to preclude forming a dense obstruction consisting of collapsing rocks, which enables to arrange for removal of the collapsing rocks onto the surface together with the fluid flow discharging from the jet pump. Furthermore, regular rotation of the tubing string together with the jet pump enables to avoid sticking of the tubing string with the jet pump to the well walls, which eliminates the necessity to perform additional works on cleaning the well and, consequently, to reduce the time for studying and testing formations in wells with walls not fixed with a casing string.

DESCRIPTION OF THE PREFERRED EMBODIMENT OF THE INVENTION

Figure 1:
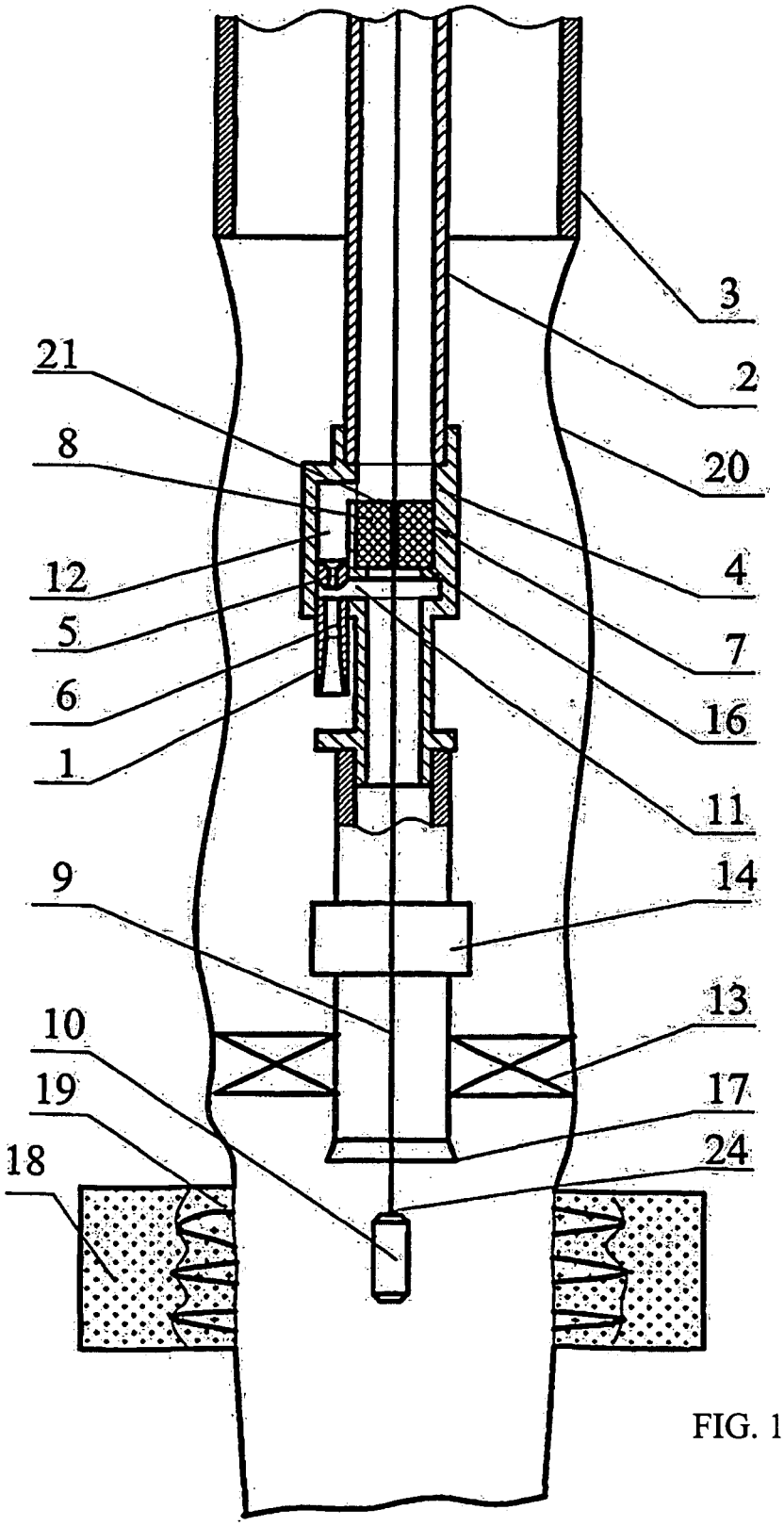
FIG. 1 is a lengthwise section of the well jet device in the process of testing a well with an radiation source and a receiver-transducer of physical fields installed.
Figure 2:
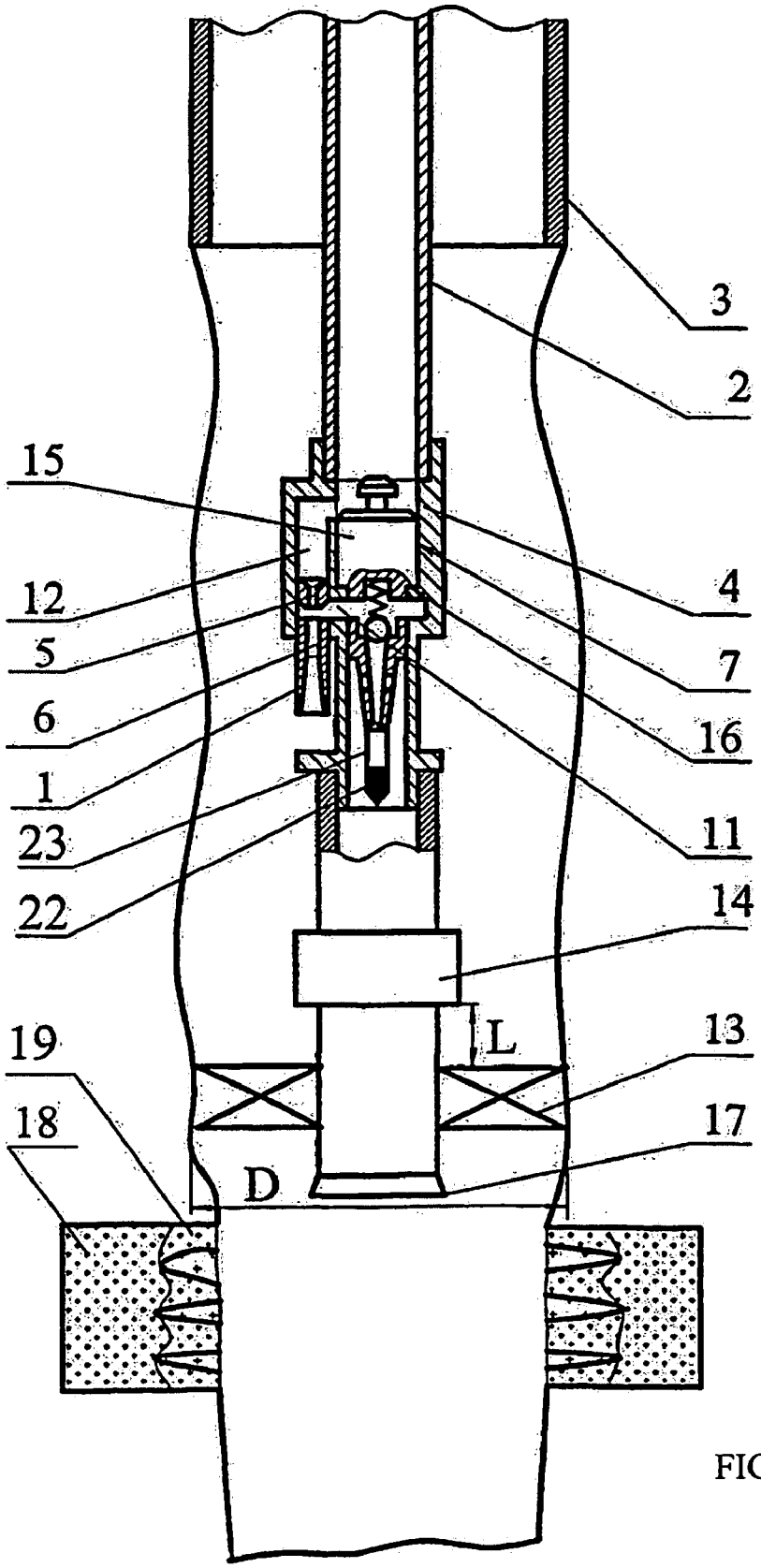
FIG. 2 is a lengthwise section of the well jet device in the process of testing a well with an installed insert for recording curves of formation pressure restoration in the under-packer area of a well.

The inventive well jet device for realization of the described method comprises the jet pump 1 installed on the tubing string 2 in the well with the intermediate casing string 3 and the open borehole 20. In the body 4 of the jet pump 1 the active nozzle 5 and the mixing chamber 6 are coaxially arranged and the through passage 7 is made with a mounting seat 16 for installing either the sealing unit 8 with the axial passage 21 or the insert 15 for recording curves of formation pressure restoration together with the sampler 22 and the autonomous instrument 23 provided with a pressure sensor, a temperature sensor, a flow rate sensor, a formation fluid composition sensor, etc. The device is provided with the radiation source and the receiver-transducer of physical fields 10 installed on the logging cable or the wire 9 and arranged below the jet pump 1. The output side of the jet pump 1 is connected to the annular space of the tubing string 2, the input side of the passage 12 for supplying the working medium to the active nozzle 5 is connected to the inner cavity of the tubing string 2 above the sealing unit 8, and the passage 11 for supplying the medium pumped out of the well by the jet pump 1 is connected to the inner cavity of the tubing string 2 below the sealing unit 8. The packer 13 is arranged on the tubing string 2 below the jet pump 1. The jet pump 1 and the packer 13 are arranged in the well below the casing string 3. The tubing string 2 is provided with the rotating mechanism 14 arranged between the jet pump 1 and the packer 13. The section of the tubing string 2 above the rotating mechanism 14 is arranged with the possibility of being rotated relative to the tubing string section disposed below the rotating mechanism 14 with the use of the drive located on the surface, and the rotating mechanism 14 is arranged above the packer 13 at the distance L which is equal to or greater than the external diameter D of the packer 13.

The described method of operating the well jet device in studying and testing wells is realized as follows.

The jet pump 1 and arranged below the jet pump 1 the rotating mechanism 14, the packer 13 and the input cone with the shank 17 are installed on the tubing string 2 in the well. Then the packer is released in the annular space of the tubing string 2, which enables to separate the well space. The section of the tubing string 2, as arranged above the rotating mechanism 14, is rotated. Then the radiation source and the receiver-transducer of physical fields 10 are connected to the lug 24 of the logging cable or the wire, and the sealing unit 8 is arranged on the cable or the wire 9 with the possibility of reciprocal motion of the logging cable or the wire 9, and this assembly is lowered into the inner cavity of the tubing string 2. In the process of lowering background measurements of temperature and other physical fields are made from the head to the bottom of the well. After this a liquid working medium is supplied through the tubing string 2 to the active nozzle 5 of the jet pump 1, which enables to start pumping the formation medium out of the under-packer area with the use of the jet pump 1. Thus the producing formation 18 is drained and near-well area 19 of the formation 18 is cleared of the drilling fluid filtrate, which results in emerging temperature anomalies in the interval of the working sections of the producing formation 18. The parameters in the under-packer area of the well are monitored with the use of the radiation source and the receiver-transducer of physical fields 10, while successively creating different values of pressure drawdown on the formation, registering, at each value, well bottom pressures, the composition and the physical parameters of the fluid coming out of the producing formation as well as the well output. Then, while operating the jet pump 1 at a set value of pressure drawdown on the formation 18, the radiation source and the receiver-transducer of physical fields 10 are moved along the well axis in the area of the producing formation 18, and the inflow profile, the parameters of the formation fluid, the well bottom pressure as well as changes of the physical fields in the near-well area and the remote area (the well area located beyond the near-well area) of the formation are registered, the possibility of performing the above operations is provided for several times both at the above-mentioned set value of pressure drawdown on the formation and at another value of pressure drawdown on the formation. Then the supply of the liquid medium to the jet pump 1 is stopped, the radiation source and the receiver-transducer of physical fields 10 together with the logging cable or the wire 9 and the sealing unit 8 are removed out of the well. The section of the tubing string 2 with the jet pump 1 is rotated with the use of the drive located on the surface, which prevents them from being stuck in the well due to collapse of the well walls. Then, lowered along the tubing string 2 and installed on the mounting seat 16 in the through passage 15 is an insert for recording curves of formation pressure restoration in the under-packer area of the well, the said insert being lowered together with the sampler 22 and the autonomous instrument 23 provided with a pressure sensor, a temperature sensor, a flow rate sensor, a formation fluid composition sensor, etc. The formation fluid is pumped out and the necessary pressure drawdown on the formation 18 is created with the jet pump 1, and after the set time of draining the producing formation the supply of the liquid medium to the nozzle 5 of the jet pump 1 is stopped abruptly. A curve of formation pressure restoration in the under-packer area of the well is recorded, and the section of the tubing string 2 disposed above the rotating mechanism 14 is rotated once again, after which the insert 15 is extracted and then the jet pump 1 with the whole assembly is removed out of the well to the surface.

INDUSTRIAL APPLICABILITY

This invention may be applied in the oil production industry or the mining industry for testing and studying oil or gas wells at the stage of drilling.

What is claimed is:

1. A well jet device for testing and studying formations, comprising a jet pump installed on the tubing string in a well with the casing string, in the body of the jet pump an active nozzle and a mixing chamber are coaxially arranged and a through passage is made with a mounting seat for installing either a sealing unit with an axial passage or replaceable functional inserts with autonomous instruments arranged below them, the output side of the jet pump being connected to the tubing string annular space, and the input side of the passage for supplying the working medium to the active nozzle of the jet pump being connected to the inner cavity of the tubing string above the sealing unit, and the passage for supplying the medium pumped by the jet pump out of the well being connected to the inner cavity of the tubing string below the sealing unit, the said well jet device being provided with a radiation source and a receiver-transducer of physical fields and with a packer, these being arranged, respectively, on the cable and on the tubing string below the jet pump, the jet pump and the packer being arranged in the well below the casing string, the tubing string being provided with a rotating mechanism being arranged between the jet pump and the packer, and the section of the tubing string disposed above the rotating mechanism being arranged with the possibility of rotating it relative to the section of the tubing string disposed under the rotating mechanism by means of a drive arranged on the surface, and the rotating mechanism being arranged above the packer at a distance equal to or greater than the external diameter of the packer.

2. A method of operating a well jet device when testing and studying wells, consisting in installing, bottom-up, an input cone with a shank, a packer, a rotating mechanism and a jet pump, wherein in the latter's body a stepwise through passage with a mounting seat between the steps is provided, lowering the whole assembly on the tubing string into the well, the said input cone being arranged not lower than the bed of the producing formation, then releasing the packer, and rotating the section of the tubing string, which is disposed above the rotating mechanism, then, lowering into the well, through the jet pump, a radiation source and a receiver-transducer of physical fields together with a sealing unit that is movable arranged on a logging cable or a wire above the lug for connecting said radiation source and receiver-transducer of physical fields; arranging the sealing unit onto the mounting seat in the through passage of the jet pump body while ensuring the possibility for reciprocal motion of the logging cable or the wire; during the process of lowering making background measurements of temperature and other physical fields from the head to the bottom of the well, then arranging the radiation source and the receiver-transducer of physical fields above the bed of the producing formation, clearing the near-well area of the formation of the drilling fluid filtrate by supplying a liquid medium to the active nozzle of the jet pump while successively creating several values of pressure drawdown on the formation and registering, at each value, well bottom pressures, the composition and the physical parameters of the fluid coming out of the producing formation as well as the well output, then, while operating the jet pump at a set value of pressure drawdown on the formation, moving the radiation source and the receiver-transducer of physical fields along the well axis in the area of the producing formation, and registering the inflow profile, the parameters of the formation fluid, the well bottom pressure as well as changes of the physical fields in the near-well and the remote areas of the formation; wherein the above operations are optionally performed several times for both at the above-mentioned set value of pressure drawdown on the formation and at another value of pressure drawdown on the formation, then stopping the supply of the liquid medium to the jet pump, removing out of the well the radiation source and the receiver-transducer of physical fields together with the logging cable and the sealing unit, and rotating the section of the tubing string disposed above the rotating mechanism, then, lowering along the tubing string and installing on the mounting seat of the through passage an insert for recording curves of formation pressure restoration in the under-packer area of the well, lowering the said insert together with a sampler and an autonomous instrument provided with a pressure sensor, a temperature sensor, a flow rate sensor, a formation fluid composition sensor, creating a necessary pressure drawdown on the formation by supplying the liquid medium to the nozzle of the jet pump, and after the set time of draining the producing formation abruptly stopping the supply of the liquid medium to the jet pump nozzle, and after the set time of recording a curve of formation pressure restoration in the under-packer area of the well removing the functional insert for recording curves of formation pressure restoration together with the sampler and the autonomous instrument, rotating once again the section of the tubing string disposed above the rotating mechanism, and removing the jet pump together with its assembly out of the well to the surface.

* * * * *